US006428068B1

(12) United States Patent
Lavine

(10) Patent No.: US 6,428,068 B1
(45) Date of Patent: Aug. 6, 2002

(54) GOLF BALL RETRIEVER

(76) Inventor: David M. Lavine, 800 8th Ave., Suite 200, Fort Worth, TX (US) 76104

( * ) Notice: Subject to any disclaimer, the term of this patent is extended or adjusted under 35 U.S.C. 154(b) by 0 days.

(21) Appl. No.: 09/842,415

(22) Filed: Apr. 25, 2001

(51) Int. Cl.[7] ..... A63B 47/02
(52) U.S. Cl. ..... 294/19.2; 294/66.1
(58) Field of Search ..... 294/1.4, 19.1, 294/19.2, 55, 66.1; 473/177, 286

(56) References Cited

U.S. PATENT DOCUMENTS

| | | | | | |
|---|---|---|---|---|---|
| 1,829,283 | A | * | 10/1931 | Kip | 473/177 |
| 2,432,906 | A | * | 12/1947 | Klingler | 294/19.2 |
| 3,180,644 | A | * | 4/1965 | Winquist | 294/19.2 X |
| 3,306,649 | A | | 2/1967 | Zagwyn | 294/19.2 |
| 3,749,407 | A | | 7/1973 | Prochnow | 294/19.2 X |
| 3,770,308 | A | * | 11/1973 | Faber et al. | 294/19.2 |
| 4,509,751 | A | | 4/1985 | Tabet | 294/19.2 X |
| D283,432 | S | | 4/1986 | Rosenow | D21/206 |
| 5,360,247 | A | * | 11/1994 | Vackter | 294/55 X |
| 5,460,366 | A | * | 10/1995 | Pugh | 294/19.2 X |
| 5,899,511 | A | | 5/1999 | Dinatale | 294/19.2 |
| 5,921,598 | A | | 7/1999 | Bredow | 294/19.2 |
| 6,120,387 | A | | 9/2000 | Bobst | 473/286 |
| 6,257,635 | B1 | * | 7/2001 | Torelli | 294/19.2 |

FOREIGN PATENT DOCUMENTS

| | | | | |
|---|---|---|---|---|
| GB | 2035185 | * | 6/1980 | 294/19.2 |
| GB | 2074926 | * | 11/1981 | 294/19.2 |

* cited by examiner

*Primary Examiner*—Johnny D. Cherry
(74) *Attorney, Agent, or Firm*—Bracewell & Patterson, LLP

(57) ABSTRACT

A ball retrieving body has a first extent defined by sidewalls which terminate in an open ball retrieving end. The open ball retrieving end has an inside area sized to be greater than the outside diameter of a standard golf ball for the receipt thereof. The open ball retrieving end has a fluid narrowing profile that creates a venturi effect as the ball retrieving body approaches and comes into contact with the golf ball. The sidewalls of the first extent have a pluraly of apertures formed therein to allow the flow of water to add to the venturi effect. The ball retrieving body also has a second extent defined by cylindrical sidewalls that intersect the sidewalls of the first extent and continue inwardly within the initially open interior of the ball receiving body. The sidewalls of the second extent form an internal section having an outer surface which allows a golf ball to rest on the outer surface and not fall out of the open ball retrieving end. The length of the internal section is also suitable to keep the golf ball from passing through the entire annular region of the first extent. The second elongate extent also has a ferrule opening sized for engaging the tapered end of a ferrule of a standard golf flag stick whereby the ball retrieving body can be supported from a standard golf flag stick to allow a user to retrieve a golf ball from a location distant from the user.

8 Claims, 2 Drawing Sheets

GOLF BALL RETRIEVER

BACKGROUND OF THE INVENTION

1. Technical Field

The present invention relates to golfing accessories and, more specifically, to a golf ball retrieving accessory that can fit on the end of a standard golf flag stick and which can assist in retrieving golf balls from hazards including water hazards.

2. Description of the Related Art

Devices are generally known for retrieving golf balls. Frequently, golf balls are lost in hazards including pools of water from which they then need to be retrieved. Known retrievers generally comprise a net or cup attached to a handle for scooping up a ball that is located in a body of water. The retrievers either have moving parts which are unreliable or nonmoving parts which require excessive manipulation and dexterity in order to capture and retrieve the golf ball. Prior art golf ball retrievers with moving parts are difficult to operate and are expensive to manufacture. Prior art golf ball retrievers without moving parts are often also difficult to manipulate because they require balancing the golf ball or moving the golf ball within the retriever itself in order to properly retain the ball during retrieval. Certain of the prior art devices require pressure to be placed on the ball before it can be adequately captured. Other prior art devices require great patience to use and experience in perfecting the technique employed.

In addition, some golfers feel that having a retriever showing among their golf clubs somehow reflects on their prowess and is suggestive of poor golf skills. It presupposes their inability to avoid hazards and produces the idea of a poor golfer who frequently must retrieve errant golf balls. Some golf ball retrievers are secured to the end of a golf club grip or shaft. However, applicant is unaware of any current designs which can fit on the end of a standard golf flag stick.

It would be desirable to provide an easily manipulated golf-ball retriever that has no moving parts to wear out, is compact and thus a requires minimum of storage space, is able to be hidden from view until needed and is capable of attachment to a standard flag stick. It would also be desirable to provide such a golf ball retriever which is capable of retrieving a ball which is submerged in a water hazard. Additionally, it would be desirable to have a golf ball retriever that is rigid and durable enough to easily displace a partially covered golf ball for retrieving purposes if the ball is covered with sand or mud.

BRIEF SUMMARY OF THE INVENTION

It is an object of the present invention to provide a retriever attachment that maybe quickly and easily attached or detached from a standard golf flag stick without the use of tools.

It is another object of the present invention to provide a device that is compact and light weight, that may be conveniently carried in a pocket, a golf bag or snapped onto a belt, and that requires a minimum of storage space.

Another object of the invention to provide a device which facilitates the retrieving of golf balls, and the like, from water hazards and other relatively inaccessible locations, with a minimum of time and effort.

It is another object of the present invention to provide a device that is relatively inexpensive to manufacture, that is easy to clean, and that is durable.

The above objects and advantages are achieved by providing a ball retrieving body that can fit on the ferrule end of a standard golf flag stick. The preferred retrieving body has a first, generally cylindrical extent which includes a fluid narrowing profile and a second elongated extent which protrudes from the sidewalls of the first extent. The second extent has a ferrule opening at one end with an inside diameter sized for engaging the tapered end of the ferrule of a standard golf flag stick. The fluid narrowing profile, as well as a plurality of drainage apertures, together create a "venturi" type effect in use which helps to hold a golf ball within the ball retrieving body during retrieval operations.

Additional objects, features and advantages will be apparent in the written description which follows.

BRIEF DESCRIPTION OF THE DRAWINGS

The novel features believed characteristic of the invention are set forth in the appended claims. The invention itself however, as well as a preferred mode of use, will best be understood by reference to the following detailed description of an illustrative embodiment when read in conjunction with the accompanying drawings, wherein:

DETAILED DESCRIPTION OF THE PREFERRED EMBODIMENT

Figure 1:
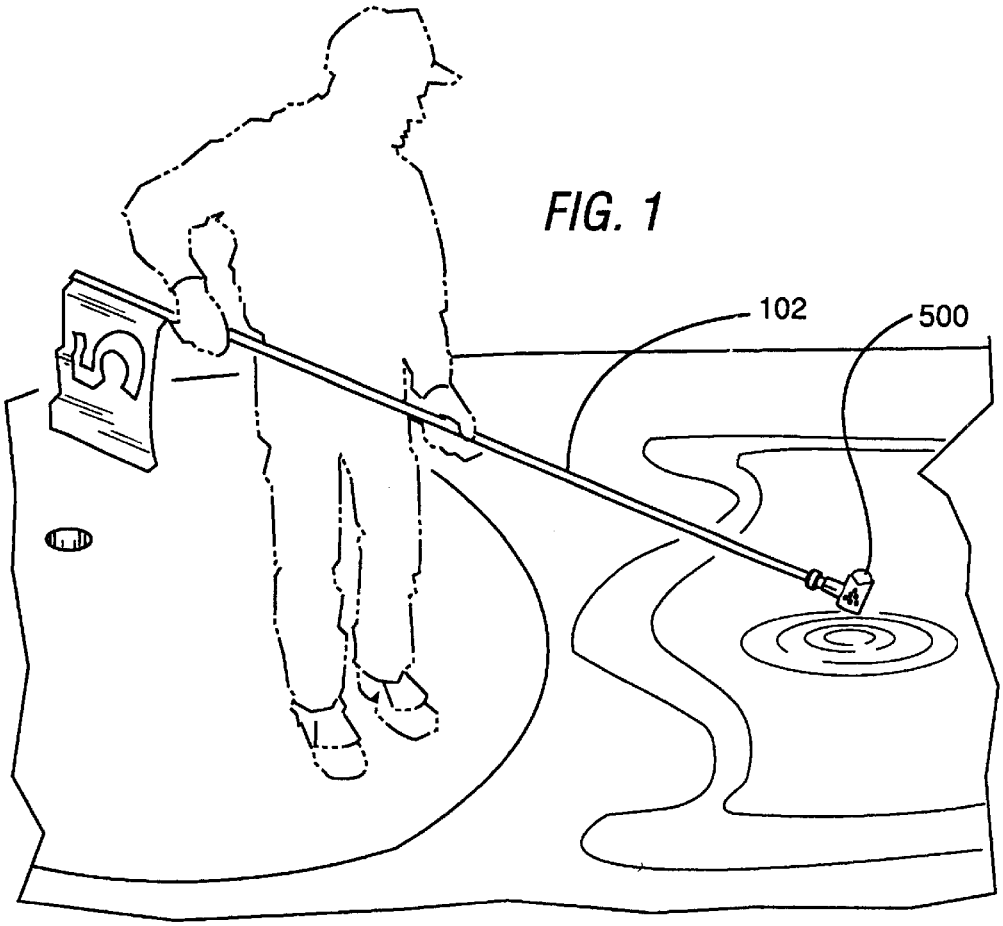
FIG. 1 is a view of the golf ball retriever of the invention in use with the user shown in phantom lines.
Figure 2:
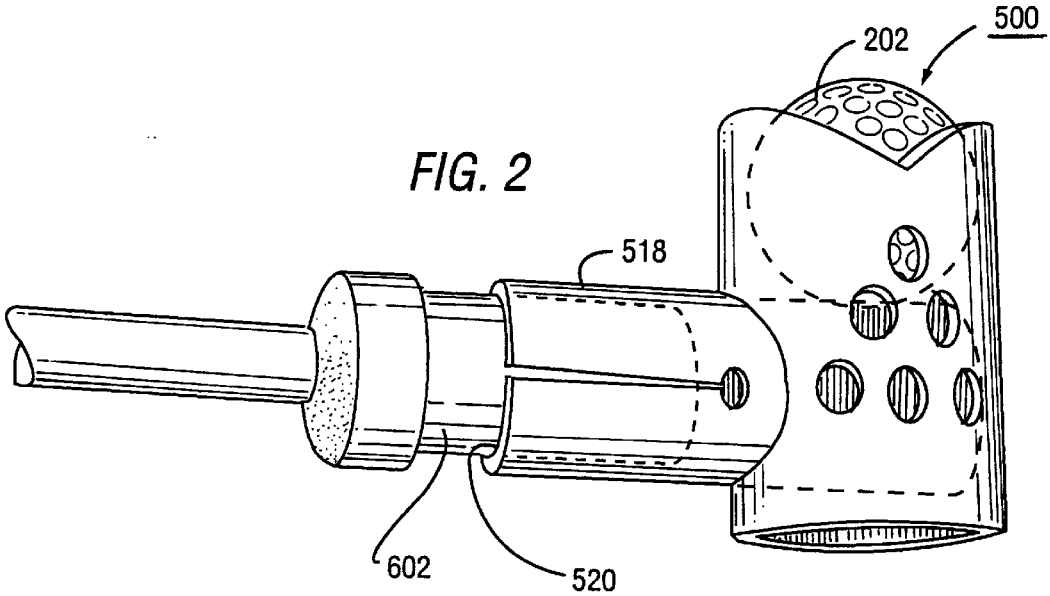
FIG. 2 is a side view of the golf ball retriever fitted on the end of a standard golf flag stick, the opposing stick end being broken away.
Figure 3:
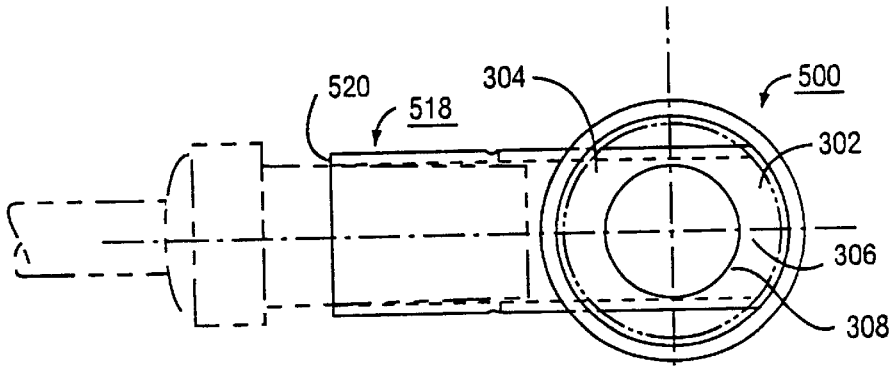
FIG. 3 is a top view of the golf ball retriever of the invention on the end of a standard golf flag stick.
Figure 4:
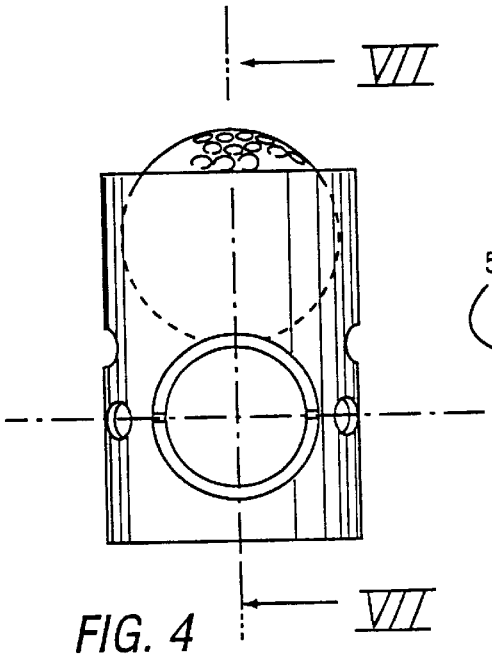
FIG. 4 is an end view of the golf ball retriever of the invention with a golf ball in the open ball retrieving end of the retriever.
Figure 5:
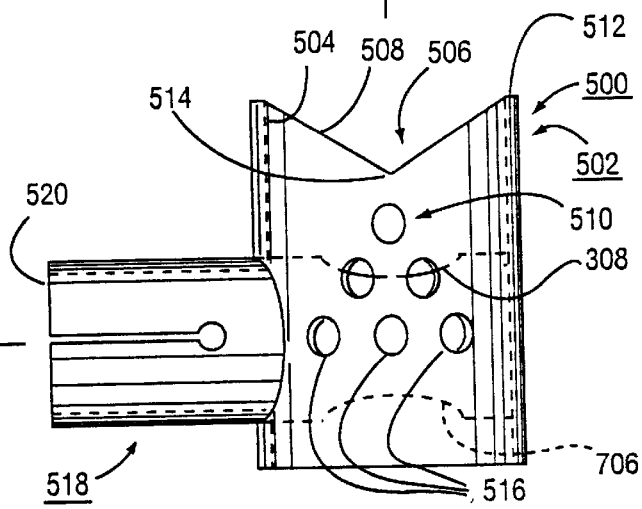
FIG. 5 is an isolated, side view of the golf ball retriever with certain of the internal components thereof shown in dotted lines.
Figure 6:
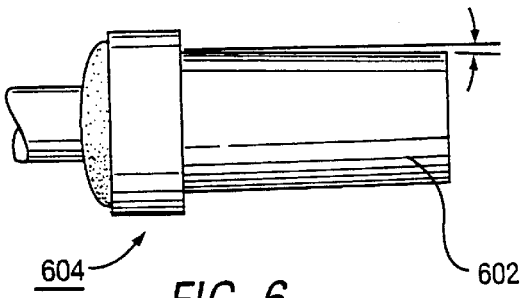
FIG. 6 is a side view of a standard golf flag stick ferrule, the remainder of the stick being broken away.

With reference to the Figures, a golf ball retriever of the invention is shown having a ball retrieving body 500 (FIGS. 3 and 5) having a first, generally cylindrical extent 502 defined by cylindrical sidewalls 504 which terminate in an open ball retrieving end 506. The open ball retrieving end 506 has an inside diameter sized to be greater than the outside diameter of a standard golf ball 202 for the receipt thereof. The open ball retrieving end 506 may have a fluid narrowing profile 508 similar to the one shown in FIG. 5. In the embodiment of FIG. 5, the profile 506 forms a "V" shape as viewed from the side. As will be explained more filly, the internal profile of the ball retrieving body also narrows to contribute to the venturi effect. The fluid narrowing profile 508 creates a venturi effect as the ball retrieving body 500 approaches and comes into contact with the golf ball 202 located, e.g., in a water hazard. As the golf ball 202 approaches the ball retrieving body 500, the fluid narrowing profile 508 of the ball retriever 500 narrows the available flow area and thus increases the velocity of the water moving through the profile area. The increase in water velocity decreases the fluid pressure inside an annular region 510 of the ball retriever 500 and creates an attractive force between the annular region 510 of the ball retriever 500 and the golf ball. The water flow region within the body 500 continues to narrow until the golf ball 202 comes into contact with the extended portion 512 of the profile 508. When the golf ball 202 is in contact with the extended portion 512 of the profile 508, the only place the water can continue to flow is in the recessed portion 514 of the profile 508. Because the available area for water flow is decreasing, the velocity of the water flow is increased. This creates a significant decrease in fluid pressure inside the annular region 510 of the ball retriever 500 which essentially helps to draw or suck the golf ball 202 into the retriever. The fluid narrowing profile 508 is not limited to the shape as shown in FIG. 5 but could be any shape that would increase the flow of water and create a decrease in pressure inside the annular region 510 of the ball retriever 500.

Figure 7:
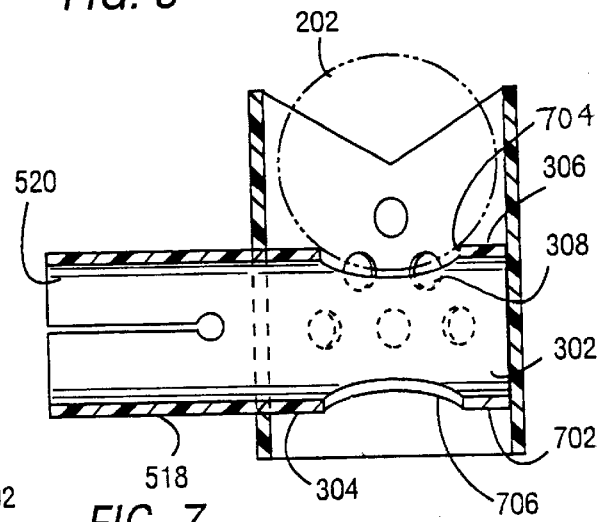
FIG. 7 is a side partial sectional view of the golf ball retriever of the invention with a golf ball in the open ball retrieving end thereof.

As shown in FIGS. 5 and 7, the cylindrical sidewalls 504 are preferably provided with a plurality of apertures 516 to allow water to flow through the ball retrieval body. The apertures 516 assist the fluid narrowing profile 508 in creating the venturi effect. Because the apertures allow a continuous flow of water, the venturi effect is enhanced. The apertures 516 can be of a variety of sizes or configurations. A majority of the apertures 516 are located below a centerline which intersects the cylindrical sidewalls 504 of the ball retrieving body 500.

While the ball retrieving body 500 is illustrated as having a cylindrical open ball end for receipt of the golf ball, other shapes can also be utilized. For example, the entire first extent 502 may be square, triangular, or any other shape so long as the inside area of the open ball end 506 is larger than the outside diameter of a standard golf ball 202.

The ball retrieving body 500 also has a second elongated extent 518 which protrudes from the cylindrical sidewalls 504 of the first extent 502 at an angle generally perpendicular thereto at one selected location. The second elongate extent 518 has a ferrule opening 520 at one end with an inside diameter sized for engaging the tapered end 602 of a ferrule 604 of a standard golf flag stick 102 such that the ball retrieving body 500 can be supported from the standard golf flag stick 102 to allow a user to retrieve the golf ball 202 from a location distant from the user. The United States Golfers Association (USGA) does not prohibit ferrule 604 sections of varying diameters. The USGA definition only requires that the flagstick 102 be circular in cross-section to prohibit non-circular features in the lower part of the flagstick. (For further information see USGA decision 17/3 based on USGA Rule 17 The Flagstick: "The 'flagstick' is a movable straight indicator, with or without bunting or other material attached, centered in the hole to show its position. It shall be circular in cross-section.") While the USGA does allow ferrule 604 sections of varying diameters, almost all golf courses have adopted a standard ferrule 604 size.

The second generally cylindrical elongated extent 518 of the ball retrieving body 500 intersects the cylindrical sidewalls 504 of the first extent 502 and continues inwardly inside the annular region 510 of the first extent 502 within the initially open interior annular region 510 of the ball receiving body 500. An internal section 302, preferably cylindrical, is formed having an outer cylindrical surface 304 and a front side 306 and a back side 702. The front side 306 of the internal section 302 is in spaced relationship with the open ball retrieving end 506 such that the golf ball 202 can rest on the front side 306 of the internal section 302 and not easily fall out of the open ball retrieving end 506. The length of the internal section 302 maybe any length suitable to keep the golf ball 202 from passing through the entire annular region 510 of the first extent 502. The front side 306 of the outer cylindrical surface 304 may have an opening therein which forms a ball receiving seat 704 within the annular region 510 of the first extent 502.

If the length of the internal section 302 is such that a significant portion of the internal section 302 blocks the flow of water through the annular region 510 of the first extent 502, the internal section 302 may have at least one opening 308 to allow for the continuous flow of water through the annular region 510 of the first extent 502. By allowing for a continuous flow of water, the water is not slowed down and therefore the venturi effect created by the fluid narrowing profile 508 is not diminished. The opening 308 may be of any size and there may be a plurality of openings 308. In addition, the opening 308 provided on the front side 306 may be larger or smaller than the opening 706 on the back side 702.

The golf ball retriever 500 is used when the golf ball 202 in located in any area that is relatively inaccessible. The retriever 500 is taken from the golf bag, pocket, or any other location where it is stored and positioned over the ferrule 604 of a flag stick 102. If the golf ball 202 is underwater, the user simply makes a general scooping motion towards the golf ball 202. The venturi effect created by the retriever 500 will assist the user in capturing the golf ball 202 in the retriever 500. Once the golf ball 202 is positioned in the retriever 500, the user withdraws the retriever 500 out of the water with the golf ball 202 in the open ball retrieving end 506. If the golf ball 202 is not underwater but is in some other inaccessible area such as a dry stream bed with steep sides, then the same procedure as above is followed except the retriever 500 will not produce a venturi effect to assist the user in capturing the golf ball 202. The retriever 500 is preferably made from a plastic material and may be injection molded; however, the retriever 500 may be formed from any light weight material such as a light weight metal.

An invention has been provided with several advantages. The golf ball retriever of the invention is simple in design and economical to manufacture. The portable nature of the device allows it to be easily carried in a pocket of the user or in a golf bag. Because the retriever can be fitted to a standard golf flag stick, it is not necessary to provide an elongate handle which would complicate the design. The retriever can easily be kept out of sight until it is needed. The device can be fashioned of light weight plastic which is durable and relatively inexpensive.

What is claimed is:

1. A golf ball retriever comprising:

a ball retrieving body having a first extent defined by generally cylindrical sidewalls which terminate in an open ball retrieving end, the open ball retrieving end having an inside area sized to be greater than the outside diameter of a standard golf ball for the receipt thereof, the inside area defining an initially open interior;

the open ball retrieving end having a fluid narrowing profile that creates a venturi effect as the ball retrieving body approaches and comes into contact with the golf ball, the profile forming a "V" shape as viewed from the side;

the ball retrieving body also having a second, elongated extent which protrudes from the sidewalls of the ball retrieving body at one selected location, the second elongate extent having a ferrule opening sized for engaging the tapered end of a ferrule of a standard golf flag stick whereby the ball retrieving body can be supported from a standard golf flag stick to allow a user to retrieve a golf ball from a location distant from the user; and wherein the sidewalls of the first extent have a plurality of apertures formed therein to allow a flow of water through the initially open interior as a ball is received within the ball retrieving end, wherein the flow of water adds to the venturi effect.

2. The golf ball retriever of claim 1, wherein the second extent is generally cylindrical and is defined by cylindrical sidewalls.

3. The ball retrieving body of claim 1, wherein the cylindrical sidewalls of the ball retrieving body are bisected by a centerline and wherein a majority of the plurality of apertures are located below the centerline in a direction opposite the open ball retrieving end.

4. The golf ball retriever of claim 1, wherein the second, elongate extent protrudes from the generally cylindrical sidewalls of the ball retrieving body at an angle generally perpendicular thereto.

5. The golf ball retriever of claim 1, wherein the golf ball retriever is injection molded from a plastic material.

6. The golf ball retriever of claim 1, wherein the golf ball retriever is formed from a light weight metal.

7. A golf ball retriever comprising:

a ball retrieving body having a first extent defined by generally cylindrical sidewalls which terminate in an open ball retrieving end, the open ball retrieving end having an inside area sized to be greater than the outside diameter of a standard golf ball for the receipt thereof, the inside area defining an initially open interior;

the open ball retrieving end having a fluid narrowing profile that creates a venturi effect as the ball retrieving body approaches and comes into contact with the golf ball;

the ball retrieving body also having a second, elongated extent which protrudes from the sidewalls of the ball retrieving body at one selected location, the second elongate extent having a ferrule opening sized for engaging the tapered end of a ferrule of a standard golf flag stick whereby the ball retrieving body can be supported from a standard golf flag stick to allow a user to retrieve a golf ball from a location distant from the user; and wherein the second, elongated extent of the ball retrieving body intersects the sidewalls of the first extent and continues inwardly within the initially open interior of the ball receiving body to form an internal cylinder having an outer surface with a front side and a back side wherein the front side of the internal cylinder is in spaced relationship with the open ball retrieving end such that the golf ball can rest on the front side of the internal cylinder and not pass through the entire initially open interior of the first extent.

8. The ball retrieving body of claim 7 wherein the front side of the outer surface has an opening therein which forms a ball receiving seat within the open interior of the ball receiving body.

* * * * *